US007493966B2

(12) United States Patent
Blangé

(10) Patent No.: US 7,493,966 B2
(45) Date of Patent: Feb. 24, 2009

(54) SYSTEM AND METHOD FOR DRILLING USING A MODULATED JET STREAM

(75) Inventor: Jan-Jette Blangé, Rijswijk (NL)

(73) Assignee: Shell Oil Company, Houston, TX (US)

( * ) Notice: Subject to any disclaimer, the term of this patent is extended or adjusted under 35 U.S.C. 154(b) by 134 days.

(21) Appl. No.: 10/563,899

(22) PCT Filed: Jul. 9, 2004

(86) PCT No.: PCT/EP2004/051426

§ 371 (c)(1),
(2), (4) Date: Jan. 9, 2006

(87) PCT Pub. No.: WO2005/005767

PCT Pub. Date: Jan. 20, 2005

(65) Prior Publication Data

US 2006/0266554 A1 Nov. 30, 2006

(30) Foreign Application Priority Data

Jul. 9, 2003 (EP) ..... 03077160

(51) Int. Cl.
*E21B 7/16* (2006.01)
*E21B 7/18* (2006.01)

(52) U.S. Cl. ..... 175/54; 175/67; 175/424

(58) Field of Classification Search ..... 175/45, 175/54, 67, 71, 424; 299/17; 405/138; 451/75, 451/91, 102

See application file for complete search history.

(56) References Cited

U.S. PATENT DOCUMENTS

| | | | | |
|---|---|---|---|---|
| 2,868,509 | A * | 1/1959 | Williams | 175/54 |
| 3,949,354 | A | 4/1976 | Claycomb | 340/18 |
| 4,396,071 | A | 8/1983 | Stephens | 175/50 |
| 4,478,368 | A * | 10/1984 | Yie | 239/430 |
| 4,534,427 | A * | 8/1985 | Wang et al. | 175/67 |
| 4,637,479 | A | 1/1987 | Leising | 175/26 |
| 4,673,312 | A * | 6/1987 | Nussbaumer | 405/184 |
| 4,787,465 | A | 11/1988 | Dickinson et al. | 175/67 |
| 5,291,956 | A | 3/1994 | Mueller et al. | 175/67 |
| 5,314,030 | A | 5/1994 | Peterson et al. | 175/26 |
| 5,320,289 | A * | 6/1994 | Hashish et al. | 239/434 |
| 5,944,123 | A | 8/1999 | Johnson | 175/73 |
| 6,109,370 | A | 8/2000 | Gray | 175/61 |
| 6,510,907 | B1 | 1/2003 | Blange | 175/67 |
| 6,702,940 | B2 | 3/2004 | Blange | 210/222 |

FOREIGN PATENT DOCUMENTS

| | | |
|---|---|---|
| CN | 1367294 | 4/2002 |
| EP | 0069530 | 1/1983 |
| GB | 2284837 | 6/1995 |

(Continued)

*Primary Examiner*—Kenneth Thompson

(57) ABSTRACT

A system and method for making a hole in an object, the system having jet means for generating an abrasive jet formed of a mixture of a fluid and abrasive particles, and for blasting the abrasive jet with an erosive power into impingement with the object in an impingement area, thereby eroding the object in the impingement area. The system further has a rotating means for moving the impingement area along a selected circular trajectory in the hole about its circumference, and modulation means for modulating the erosive power of the abrasive jet while the impingement area is being moved along the selected trajectory.

14 Claims, 4 Drawing Sheets

FOREIGN PATENT DOCUMENTS

| | | |
|---|---|---|
| WO | 02/34653 | 5/2002 |
| WO | 02/092956 | 11/2002 |
| WO | 2005/005766 | 1/2005 |
| WO | WO2005005765 | 1/2005 |
| WO | WO2005005768 | 1/2005 |
| WO | 2005/038189 | 4/2005 |
| WO | 2005/040546 | 5/2005 |

* cited by examiner

SYSTEM AND METHOD FOR DRILLING USING A MODULATED JET STREAM

The present application dame priority of European Patent Application No. 03077160.4 filed 9 Jul. 2003.

FIELD OF THE INVENTION

The present invention relates to a system for making a hole in an object, more particularly for making a hole in a subterranean earth formation. In particular, the system comprises jet means for generating an abrasive jet of a mixture containing a fluid and a quantity of abrasive particles and for blasting the abrasive jet with an erosive power into impingement with the object in an impingement area, thereby eroding the object in the impingement area.

The invention also relates to a method of making a hole in an object, more particularly for making a hole in a subterranean earth formation. In particular, the method comprises steps of generating an abrasive jet of a mixture containing a fluid and a quantity of abrasive particles and for blasting the abrasive jet with an erosive power into impingement with the object.

BACKGROUND OF THE INVENTION

In U.S. Pat. No. 5,944,123 a drilling method is described involving the rotation of a drilling member, whereby drilling fluid is supplied to the drilling member to issue therefrom via an orifice provided therein. Off axis advance of the drilling member is achieved by modulating the rotational speed of the drilling member as it rotates.

Due to increasing friction with the bore hole wall at greater depths, the directional stability of this arrangement is expected to reduce when drilling a bore hole at relatively great depth, such as is generally required for drilling of a well for production of mineral hydrocarbons.

SUMMARY OF THE INVENTION

In accordance with the present invention there is provided a system for making a hole in an object, the system comprising jet means for generating an abrasive jet of a mixture containing a fluid and a quantity of abrasive particles and for blasting the abrasive jet with an erosive power into impingement with the object in an impingement area, thereby eroding the object in the impingement area, the system further comprising scanning means for moving the impingement area along a selected trajectory in the hole, and modulation means for modulating the erosive power of the abrasive jet while the impingement area is being moved along the selected trajectory.

There is also provided a method of making a hole in an object, the method comprising steps of

- generating an abrasive jet of a mixture containing a fluid and a quantity of abrasive particles;
- blasting the abrasive jet with an erosive power into impingement with the object in an impingement area, thereby eroding the object in the impingement area;
- moving the impingement area along a selected trajectory in the hole; and
- modulating the erosive power of the abrasive jet while the impingement area is being moved.

By modulating the erosive power of the abrasive jet while the impingement area is being moved, the amount of erosion caused by one abrasive jet in each impingement area along the selected trajectory can be varied. Herewith directional control is achieved.

A curved hole can be drilled by eroding more of the formation in a selected impingement area on one side of the hole than in another selected area on an azimuthally opposite side of the hole. A straight hole can be drilled by evenly eroding the formation in all areas on the trajectory.

In particular at greater depths, a system for making a hole in the earth formation can be disturbed by friction between the drilling arrangement and the bore hole wall surrounding the drilling arrangement. The friction causes frictional forces acting on the drilling system, which forces depend on movement of the system in the hole. When the directional control relies on the modulation of the rate of movement of the drilling system, the mentioned friction therefore disturbs the directional stability of the system.

An advantage of modulating the erosive power of the abrasive jet is that thereby the material removal rate from the object is modulated while the direct mechanical contact between the drilling tool and the bore hole wall does not have to change.

The erosive power of the abrasive jet can be modulated by modulating the power vested in kinetic energy of the abrasive particles present in the abrasive jet. This can be done by modulating the mass flow rate of the abrasive particles in the abrasive jet, for instance by modulating the quantity of the abrasive particles in the abrasive jet, or by modulating the velocity of the abrasive particles in the abrasive jet, which can be done for instance by modulating an acceleration pressure drop of the fluid in the jet means, or by combining these.

Preferably, the modulation means are coupled to modulation control means arranged to control the modulation means such that the erosive power is modulated in relation with the position of the impingement area on the selected trajectory. This way, the modulation can be arranged such that the erosive power is be increased when the abrasive jet is impinging the formation where more erosion is required, and, vice versa, the erosive power can be decreased when the abrasive jet is impinging the formation where less erosion is required.

BRIEF DESCRIPTION OF THE DRAWINGS

The invention will now be illustrated by way of example, with reference to the accompanying drawing wherein FIG. 1. schematicaily shows a cross section of a system for making a hole in a subterranean earth formation in accordance with an embodiment of the invention.

DETAILED DESCRIPTION OF THE INVENTION

Figure 1:
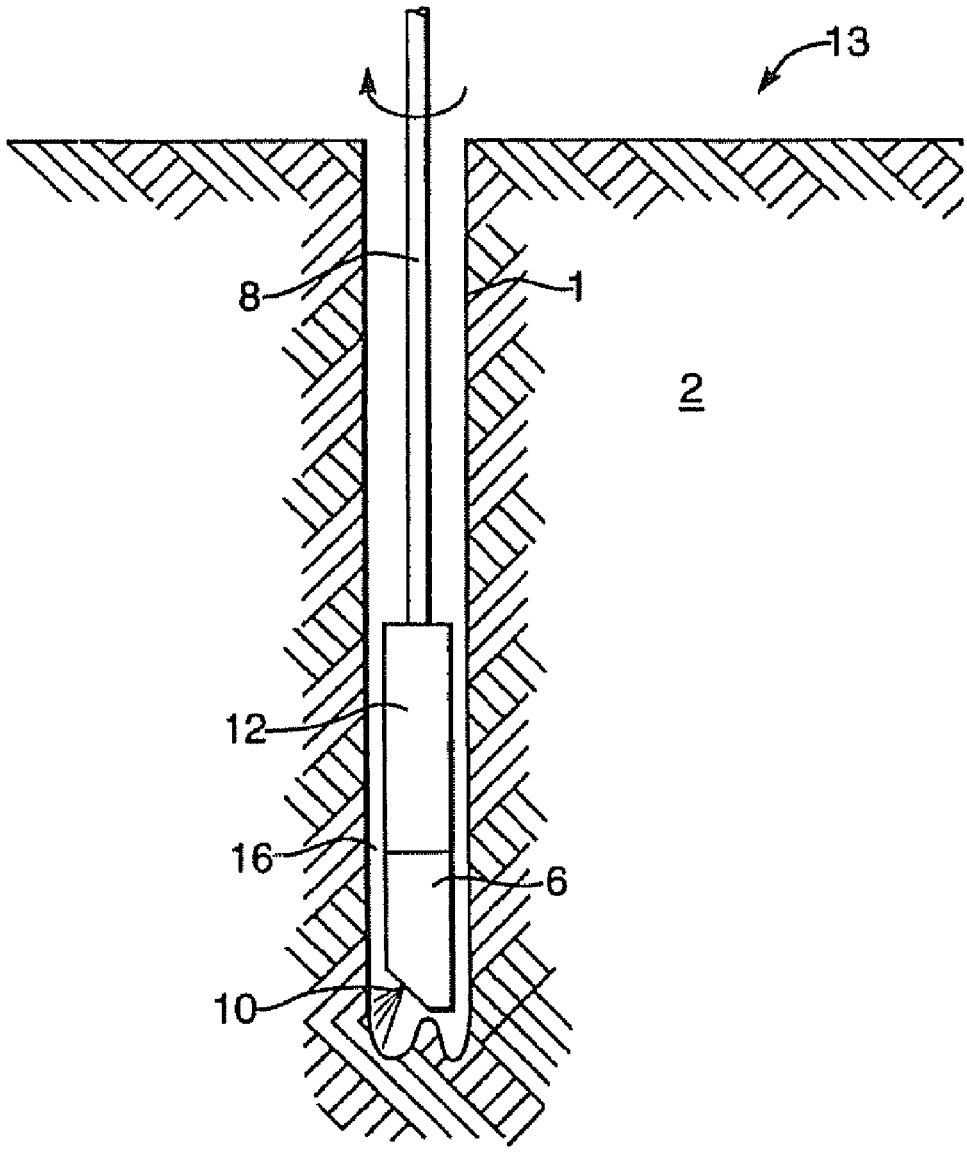

In the figures, like parts carry identical reference numerals.

FIG. 1 schematically shows a system for making a hole 1 in an object in the form of a subterranean earth formation 2, in particular a hole for the manufacture of a well for production of mineral hydrocarbons. The system comprises an excavating tool 6 mounted on a lower end of a drill string 8 that is inserted from the surface 13 into the hole 1. The drill string 8 is provided with a longitudinal passage for transporting a drilling fluid to the excavating tool 6. The excavating tool 6 comprises jet means (not shown) arranged to generate an abrasive jet 10 in a jetting direction into impingement with the earth formation 2 in an impingement area. The abrasive jet has a certain erosive power that can be modulated.

The system further comprises scanning means (not shown) arranged to move the abrasive jet along the formation, thereby moving the impingement area along a trajectory. In the system of FIG. 1, the scanning means is provided in the form of rotary means (schematically represented by the arrow) for rotating the abrasive jet in the hole about a rotary axis, which rotary axis essentially coincides with a longitudinal direction of the hole. Since the impingement area is located eccentric with respect to the rotary axis, rotating the abrasive jet in the hole results in the jet and the impingement area moving along an essentially circular trajectory in the hole. Preferably, the eccentric impingement area overlaps with the centre of rotation, so that also the middle of the bore hole is subject to the erosive power of the abrasive jet.

The drill string 8 is also provided with a controller unit 12, such that the controller unit is located inside the hole. Alternatively, the controller unit can be positioned at the surface 13. The controller unit 12 can house equipment such as modulation means to modulate the erosive power of the abrasive jet 10 impinging the formation 2. Modulating the erosive power includes controlling the erosive power.

In operation, the system works as follows. A stream of drilling fluid is pumped by a suitable pump (not shown) through the longitudinal passage of the drill string 8. Part or all of the drilling fluid is led to the jet means where an abrasive jet 10 is generated. The abrasive jet is blasted into impingement with the formation. The formation is eroded in the impingement area as a result of the abrasive jet 10 impinging the formation 2.

Simultaneously, the abrasive jet is rotated about the rotary axis. Thus, the impingement area is moved along a circular trajectory in the hole so that the formation can be eroded at all azimuths. By modulating the erosive power of the abrasive jet a high degree of directional control can be achieved.

By keeping the erosive power of the abrasive jet constant, the formation is eroded evenly on all sides of the hole and consequently the hole is excavated straight. Nevertheless, distortions in the rotating of the excavation tool, or variations in rock formation properties in the hole region, or other causes may result in uneven erosion in the hole. A directional correction may be required by modulating the erosive power to compensating for the unintentional uneven erosion. The erosive power of the abrasive jet can also be modulated in order to deliberately excavate a curved hole.

When the abrasive jet is oriented to impinge the formation in an area that requires more erosion in order to establish the directional correction, the erosive power of the abrasive jet can be periodically increased resulting in a higher erosion rate in that area. Alternatively, or in combination, the erosive power of the abrasive jet can be reduced when the abrasive jet is oriented to impinge the formation in an area that requires less erosion.

It is thus preferred that the modulation means comprises modulation control means arranged to control the modulation means such that the erosive power of the abrasive jet is modulated in relation with the position of the impingement area on the selected trajectory.

In order to establish the position of the impingement area, the system can be provided with a positional sensor, for instance a measurement while drilling sensor, for providing a signal indicative of the position of the abrasive jet. In order to establish the current drilling direction through the formation, the system can be provided with a navigational sensor, for instance a measurement while drilling sensor, for providing a signal indicative of the direction under which the making of the hole in the earth formation progresses.

Such a navigational sensor can be provided in the form of one of or a combination of a directional sensor providing a signal indicative of the direction of the device relative to a reference vector; a positional sensor providing a signal indicative of one or more positional coordinates relative to a reference point; a formation density sensor providing information on a distance to a change of formation type or formation content nearby; or any other suitable sensor.

The mechanical forces on the drilling system that is based on abrasive jetting are much smaller than is the case for systems based on mechanical rock removal. This has the advantage that the sensors can be located very close to the excavating tool, making early and accurate signal communication possible to the modulation control means. The sensors can for instance be provided in the same chamber as the modulation control means.

Alternatively, the position and and/or the direction of progress through the formation of the abrasive jet can be determined on the basis of parameters available on the surface 13, including torque on the drill string 8 and azimuthal position of the drill string 8, and axial position and velocity of the drill string 8.

A decision to change or correct drilling direction may also be taken via the operator of the directional system at surface. In case of the signal originating from a down-hole measurement while drilling sensor, a mud-pulse telemetry system or any other suitable data transfer system can be employed to transfer the data to the surface. Via similar means of data transfer a control signal can be sent to the down hole control means triggering a series of control actions required for the desired direction drilling correction.

A thruster (not shown) is advantageously provided for pressing the abrasive jetting system upon the bottom of the hole 1. Best results are obtained when the pressing force is not much higher than what is required to keep the excavating tool 6 at the bottom, in order to avoid unnecessary wear on the excavating tool 6, bending of the system, and loss of directional control. Thus, the pressing force is preferably just sufficient to counteract the axial recoil force of the abrasive jet and the friction forces in the thruster and between the abrasive jet system and the hole wall. Typically, the pressing force is well below 10 kN.

A suitable abrasive jet comprises a mixture containing a fluid, such as the drilling fluid, and a certain controlled quantity of abrasive particles. The erosive power of the jet correlates with the total power vested in the abrasive particles entrained in the mixture. This depends on the mass flow rate of abrasive particles and on the square of the velocity of the abrasive particles.

Thus, one way of modulating the erosive power of the abrasive jet is by modulating the velocity of the abrasive particles. When the abrasive jet is generated in jet means comprising an acceleration nozzle, the velocity of the fluid is driven by a pressure drop over a flow restriction. The square of the velocity of the fluid accelerated over a flow restriction is ideally equal to two times the pressure drop over the density of the fluid. Since the abrasive particles are entrained in the fluid, the erosive power of the abrasive jet is proportional to the pressure drop.

Another way of modulating the erosive power of the abrasive jet is by modulating the mass flow rate of the abrasive particles in the abrasive jet. This can most advantageously be achieved by modulating the quantity of abrasive particles in the mixture. When the quantity of similar particles is higher, the total erosive power of the abrasive jet increases in that more of the formation will be eroded. Modulation of the quantity of abrasive particles in the mixture does not influence the mechanical contact forces between the drilling system and the formation.

Still referring to FIG. 1, the abrasive particles will be entrained in a return stream of drilling fluid through the excavated hole, running for instance through an annular space 16 between the hole 1 and the drilling system (6, 12, 8).

In order to reduce the concentration of abrasive particles to be transported all the way back to the surface, it is preferred to provide the drilling system, preferably the excavation tool 6, with recirculation means arranged to recirculate at least a part of the abrasive particles from the return stream down stream impingement with the formation back into the abrasive jet 10 again. The abrasive particles to be recirculated can be mixed with the fresh stream of drilling fluid, for instance in a mixing chamber to which both the fresh stream of drilling fluid and the recirculated abrasive particles are admitted.

The quantity of the abrasive particles in the mixture can be modulated by modulating the rate at which the abrasive particles are recirculated to the mixing chamber.

Figure 2:
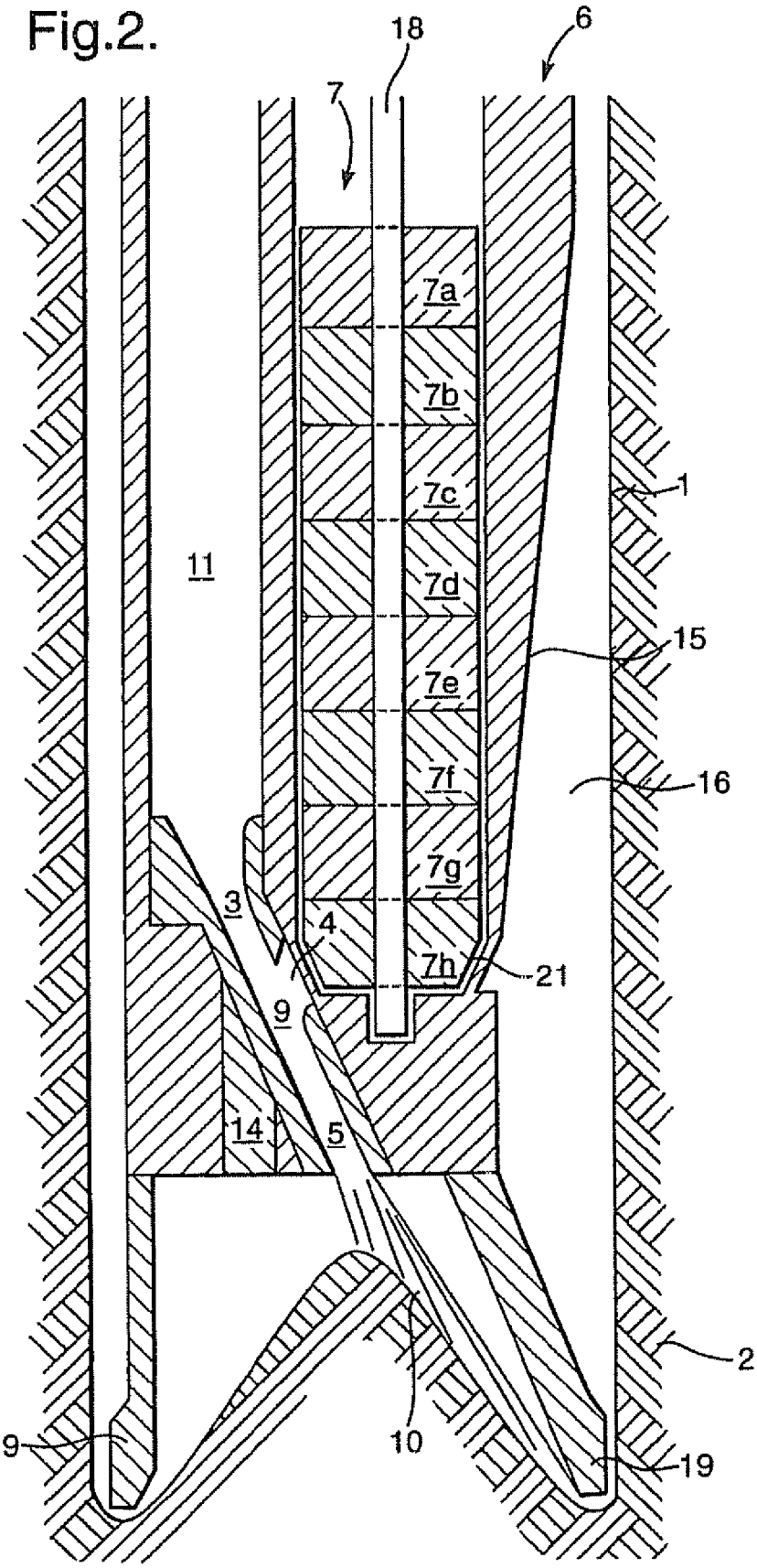
FIG. 2. schematically shows a cross section of part of a preferred excavation tool for the system of FIG. 1.

FIG. 2 schematically shows a preferred embodiment of an excavating tool 6 with recirculation capability, suitable for use in the system of FIG. 1 when applying abrasive particles containing a magnetisable material, such as for instance steel shot or steel grit.

The preferred excavating tool 6 is provided with a longitudinal drilling fluid passage 11, which is at one end thereof in fluid communication with the drilling fluid channel provided in the drill string 8 and at the other end thereof in fluid communication with jet means. The jet means comprises a mixing chamber 9 that is connected to the drilling fluid passage 11 via a first inlet, here provided in the form of drilling fluid inlet 3.

The mixing chamber 9 is also in fluid communication with a second inlet, provided here in the form of an inlet 4 for abrasive particles, and with a mixing nozzle 5 leading to a nozzle arranged to jet a stream of drilling fluid and abrasive particles against the earth formation during excavating the hole 1 in the subterranean earth formation 2.

The jet means is also provided with a piece of magnetic material 14 on the side of the mixing chamber 9 that is opposite from the abrasive particle inlet 4, but this is optional.

The mixing nozzle 5 is arranged above an optional foot part 19, and is inclined relative to the longitudinal direction of the system at an inclination angle of 15-30° relative to the rotary axis, but other angles can be used. Preferably the inclination angle is about 21°, which is optimal for abrasively eroding the bottom of the bore hole by axially rotating the complete tool inside the bore hole. The mixing chamber 9 and mixing nozzle 5 are aligned with an outlet nozzle under the same angle, in order to achieve optimal acceleration of the abrasive particles.

The drilling fluid passage 11 is arranged to bypass a device for transporting magnetic particles, which device is included in the excavating tool 6 as part of the recirculation system for the magnetic abrasive particles. The device includes a support member in the form of a slightly tapered sleeve 15 for providing a support surface extending around a conveyor means in the form of an essentially cylindrically shaped elongate magnet 7. The magnet 7 generates a magnetic field for retaining the magnetic particles on the support surface 15.

The drilling fluid passage 11 is fixedly arranged relative to the support surface 15 and the mixing chamber 9. The drilling fluid passage 11 has a lower end arranged near the inlet 4 for abrasive particles. In the present embodiment the drilling fluid passage 11 is formed inside a ridge in the axial direction which ridge is in protruding contact with the support surface 15. The drilling fluid passage 11 may alternatively be arranged freestanding from the support surface in a manner similar to that shown and described in International Publication WO 02/34653 with reference to FIG. 4 therein, or in a off-axial direction. The inlet 4 for abrasive particles is located at the lower end of the ridge.

The cylindrical magnet 7 is formed of eight smaller magnets 7*a* to 7*h* stacked together. A different number of smaller magnets can also be used. Each magnet 7*a* to 7*h* has diametrically opposed N and S poles, and the magnets are stacked in a manner that two essentially helical diametrically opposing bands are each formed by the N and S poles.

For the purpose of this specification, a magnetic pole is an area on the magnet surface or on the support surface where magnetic field lines cross the magnet surface or the support surface thereby appearing as an area of source or sink for magnetic field lines.

Directly adjacent to the diametrically opposing bands formed by the poles, helical recesses are provided for achieving helical bands having lower magnetic permeability than the helical bands including the poles. Due to the higher magnetic permeability of the magnet material than the less magnet material that fills up the recesses (a gas, a fluid, or a solid) the internal magnetic field lines predominantly follow the material of the magnet rather than the material contained in the recess. Thus, there exists a strong gradient zone between the bands containing the poles and the recesses. Instead of the recesses containing a gas, fluid or solid, there can be vacuum in the grooves.

Preferably, the recess reaches a depth with respect to the cylindrical circumference of the magnet that is similar as or greater than the distance between the gap between the magnetic surface in the first band and the support surface.

The magnet 7 has a central longitudinal shaft 18 and is rotatable relative to the sleeve 15 and about the central longitudinal shaft 18. Drive means, of which more details will be given below, are provided to drive shaft 18 and thereby rotate the magnet 7.

A short tapered section 21 is provided at the lower end of magnet 7. The support surface on sleeve 15 is provided with a corresponding conical taper in a manner that the inlet 4 for abrasive particles provides fluid communication between the support surface 15 surrounding the tapered section 21 and the mixing chamber 9. The conical taper is best based on the same angle as the above-discussed angle of the mixing chamber 9 and mixing nozzle 5.

Figure 3A:
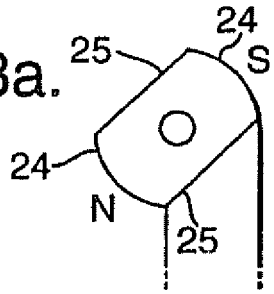
FIG. 3 schematically shows a surface map of a magnet surface arrangement for use in the preferred excavation tool of FIG. 2.
Figure 3B:
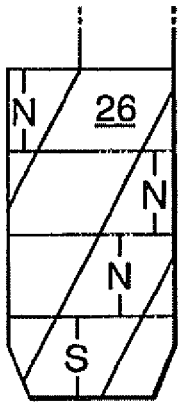
Figure 3C:
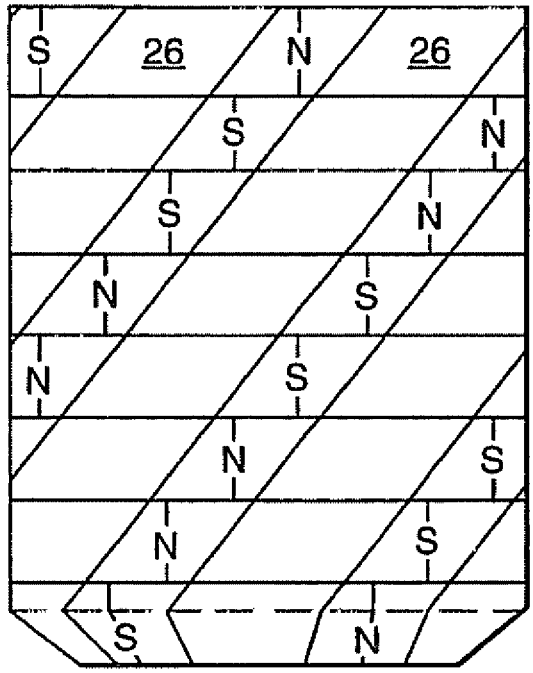

The magnet 7 is shown in more detail in FIG. 3, in a cross sectional view (FIG. 3*a*), a longitudinal view (FIG. 3*b*) of a lower part of the magnet, and a representation wherein the cylindrical surface is unrolled flat in the plane of the paper (FIG. 3*c*).

The region of reduced magnetic permeability is provided in the form of a helical recess 26 in the outer surface of the magnet 7 adjacent to the poles. FIG. 3*a* shows circular contours 24 around the diametrically opposing poles, connected by essentially straight contours 25. The straight contours correspond with the recess 26 and the circular contours with the parts of the magnet containing the poles.

The slanted phantom lines in FIG. 3*b* indicate the transition between the circular contours and the essentially straight contours.

In FIG. 3*c*, vertically is set out the height of the magnet, which is divided in smaller magnets 7*a* to 7*h*, and horizontally the surface at all azimuths between 0 and 360° is visible. As can be seen, the smaller magnets 7*a* to 7*h* are arranged such that their individual poles align in two helical bands, in the order of NSSNNSSN or SNNSSNNS. The angle θ of the helical recess 26 with the plane perpendicular to the shaft 18 is 53°.

In operation, the preferred excavating tool of FIG. 2 works as follows. The tool is connected to the lower end of the drill string 8 that is inserted from the surface 13 into the borehole. A stream of drilling fluid is pumped by a suitable pump (not shown) at surface, via the drilling fluid channel of the drill string 8 and the fluid passage 11 into the mixing chamber 9. During pumping, the stream is provided with a small amount of abrasive particles suitable in the form of steel shot.

The inlet 3 is arranged with a flow restriction, over which a pressure drop is present driving the acceleration of the drilling fluid.

The stream flows from the mixing chamber 9 via mixing nozzle 5 and is thereby jetted against the borehole bottom. Simultaneously, the drill string 8 is rotated in the way described above. The return stream of fluid and abrasive particles flows from the borehole bottom through the annulus 16 in the bore hole in a direction back to the surface. Thereby the return stream passes along the sleeve 15. The magnet 7 induces a magnetic field extending to and beyond the outer surface of the sleeve 15. As the stream passes along the sleeve 15, the abrasive particles in the stream are separated out from the stream by the magnetic forces from the magnet 7 which attract the particles onto the outer surface of the sleeve 15.

The stream of drilling fluid, which is now substantially free from abrasive magnetic particles, flows further through the bore hole to the pump at surface and is re-circulated through the drill string after removal of the drill cuttings.

The magnetic particles retained on the support surface 15 are attracted towards the band having the highest magnetic field. Simultaneously with pumping of the stream of drilling fluid, the magnet 7 is rotated about its shaft 18 in a direction of rotation that is opposite to the sense of the helical band. Due to rotation of the magnet 7, the presence of the gradient zone causes a force on the magnetic particles in a direction perpendicular to the gradient zone, which has a downward component, thereby forcing the particles to follow a helically downward movement towards the inlet 4.

In this way, the magnet 7 functions not only as a separator of abrasive particles from the return stream, but also as a conveyor means in that movement of the magnet induces transport of the abrasive particles.

As the particles arrive at the inlet 4, the stream of drilling fluid flowing into the mixing chamber 9 again entrains the particles.

In a next cycle the abrasive particles are again jetted against the borehole bottom and subsequently flow in upward direction through the borehole. The cycle is then repeated continuously. In this manner it is achieved the drill string/pumping equipment is substantially free from damage by the abrasive particles as these circulate through the lower part of the drill string only, while the drilling fluid circulates through the entire drill string 8 and pumping equipment. In case a small fraction of the particles flows through the borehole to surface 13, such fraction can be replaced via the stream of fluid flowing through the drill string 8.

A jet pump mechanism in the mixing nozzle 5 generates a strong flow of drilling fluid from the mixing chamber 9 to the mixing nozzle 5. The jet pump mechanism auxiliarily supports the flow of magnetic particles into the mixing chamber 2. A larger diameter of the mixing nozzle 5 compared to a drilling fluid inlet nozzle (between inlet 3 and the mixing chamber 9) results in adequate entrainment of drilling fluid and the magnetic abrasive particles entering into the mixing chamber via second inlet 4. The interaction between the entrained drilling fluid and the magnetic particles contributes to the efficiency of the release of particles from the support surface 15 into the mixing chamber 9 as well.

If provided, the magnetic body 14 on the side opposite from the abrasive particle inlet 4 draws part of the magnetic field generated by the magnet 7 into the mixing chamber 9. As a result, the magnetic force attracting the magnetic abrasive particles to the support surface 15 is less strong for magnetic particles that enter the region of the abrasive particle inlet 4. Thereby, entry of the magnetic abrasive particles through abrasive particle inlet 4 into the mixing chamber 2 is further facilitated. The magnetic abrasive particles have a tendency to form chains from the lower end of the support surface 15 towards the magnetic body 14 that cross through the mixing chamber 9. At the same time the particles in these chains interact with the stream of drilling fluid passing through the mixing chamber 9 from inlet 3 to mixing nozzle 5, and thereby these particles will be entrained by this stream.

In a preferred embodiment, one or more relatively short essentially axially oriented ridge sections are provided onto the support surface whereby the support surface extends beyond the ridge sections in the direction of the ridge sections. Herewith a more homogeneous distribution of the magnetic particles over the support surface is achieved as well as an improvement of the axial transport velocity of the magnetic particles over the support surface.

Suitable magnets for the described recirculation system can be made from any highly magnetisable material, including NdFeB, SmCo and AlNiCo-5, or a combination thereof.

Preferably the magnet also has a magnetic energy content of at least 140 kJ/m$^3$ at room temperature, preferably more than 300 kJ/m$^3$ at room temperature such as is the case with NdFeB-based magnets. A high energy content allows for shorter axial contact length of the support surface with the return stream, and consequently a stronger taper of the support surface which is advantageous for the axial transport rate. Also, less power is required for the rotation of the magnet.

The sleeve 15 and the drilling fluid bypass 1 are normally made of a non-magnetic material. They are suitably machined out of a single piece of the material in order to obtain optimal mechanical strength. Super alloys, including high-strength corrosion resistant non-magnetic Ni—Cr alloys, including one sold under the name Inconel 718 or Allvac 718, have been found to be particularly suitable. Other materials can be used including BeCu.

Typical dimensions relating to the excavating tool are given in the following table.

| Part name | Reference number | size |
|---|---|---|
| Outer diameter of foot part | 19 | 73 mm |
| Axial length of magnet | 7 | 120 mm |
| Outer diameter of magnet | 7 | 29 mm |
| Diameter in lower part of support surface | 15 | 34 mm |
| Diameter in upper part of support surface | 15 | 52 mm |

As an alternative for the cylindrical magnet 7 in FIG. 2, the outer diameter of the magnet and the inner diameter of the inside wall of support sleeve 15 can be made to reduce with decreasing axial height. The smaller magnets from which the magnet is assembled can be of a frustoconical shape to obtain a tapered shape of the separator magnet. The gap between the magnet and the inside wall of the support sleeve may also decrease, as well as the wall thickness of the support sleeve.

The drilling fluid in the abrasive jet may contain a concentration of typically up to 10% by volume of magnetic abrasive particles. The magnet is preferably driven at a rotational frequency exceeding the rotational frequency of the drill string, such that modulation of the magnet rotational frequency can modulate the recirculation rate of the abrasive particles with in a single rotation of the excavation tool 6. Typically the magnet can be driven at a rotational frequency of between 10 and 40 Hz. The rotation of the drill string, or at least the excavating tool, is typically between 0.3 and 3 Hz.

Generally, in a system comprising conveyor means for supplying abrasive particles to the abrasive jet, the quantity of abrasive particles in the abrasive jet can be modulated by modulating the rate of transport by the conveyor means. An advantage of this is that, other than electronic control means, no additional mechanical hardware is required for modulating the erosive power of the abrasive jet. For instance, in the above described excavation tool with the magnet 7 acting inter alia as conveyor means, the number of abrasive particles supplied in the mixing chamber is controllable via the rotational frequency of the magnet.

In order to modulate the rate of transport, there is provided controllable drive means for driving the conveyor means. The drive means can be powered by down hole power system extracting power from the pressurised drilling fluid stream and supplying the extracted power to the conveyor means. Only a small fraction of the hydraulic energy present in the fluid circulating through the hole, typically less than 5% needs to be extracted. Thus, the generator can be made much smaller than, for instance, a down hole turbine or positive displacement motor (PDM) that aims at converting a large fraction of the available energy for driving a conventional drill bit.

Figure 4:
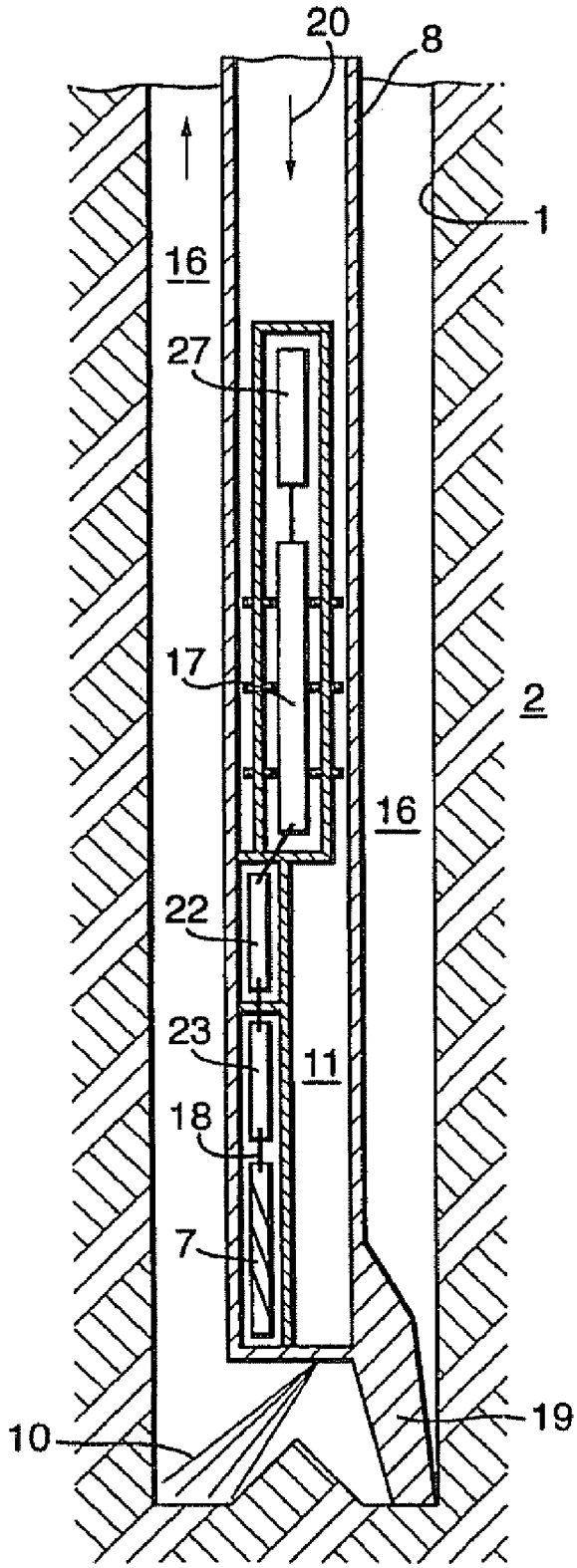
FIG. 4 schematically shows an example of a system for making a hole in a subterranean earth formation including a down hole power system.

A first type of down hole power system, of which an example is shown in FIG. 4, comprises an electric generator 17 drivable by the drilling fluid flow 20, for instance by means of a turbine or a PDM section. The electric power generated is supplied to an electric motor 23 that is coupled to the conveyor means via an output shaft 18. The electric motor 23 may be controlled by an electronic control system 22.

More than one turbine/generator module can be mounted in series in order to convert the required power. This can improve the directional flexibility of the down hole power system, because such modular approach can be constructed mechanically less stiff than a non-modular turbine assembly with a similar power rating.

A second, alternative, type of down hole power system (not shown) comprises a passive hydraulic motor, such as for instance a turbine or a positive displacement motor (PDM) section, drivable by the drilling fluid flow, of which passive hydraulic motor an output shaft is coupled to the conveyor means. Means are provided for controlling the power on the output shaft. Such means can be provided in the form of flow control means controlling the flow of drilling fluid through the passive hydraulic motor, such as an adjustable valve, preferably an electronically adjustable valve, in series with the passive hydraulic motor and/or in parallel in a bypass channel bypassing the passive hydraulic motor. A possible parallel bypass channel is disclosed in U.S. Pat. No. 4,396,071.

Alternatively, a generator can be mounted around the output shaft and act as a controlled brake that is electronically adjustable by adjusting the load in the generator circuit. The electronically adjustable valve or load may be controlled by an electronic control system.

In both the first (example in FIG. 4) and second type systems, the erosive power of the abrasive jet with the abrasive jet can be modulated via the electronic control system 22. The electronic control system may be arranged to receive a signal indicative of the position of the impingement area of the abrasive jet along its trajectory on the bottom of the hole 1, which it can then use to modulate the erosive power of the abrasive jet in dependence on the position along the trajectory. The signal can be received directly from a down hole positional sensor located in the vicinity of the excavating tool. The positional sensor can suitable be housed together with the electronic control system 22.

The electronic control system 22 may include an electronic memory module that stores data including one or more of motor voltage, current, rotational frequency, temperature and other data. A selection of this data may be transmitted to the surface via a measurement while drilling (MWD) system 27, when provided. Such measurement while drilling system 27 can be electronically connected to the electronic control system by means of a male stabber.

The electronic control system may be programmable, such that selected conditions can be maintained or achieved.

Any electronic components can be placed in an atmospheric chamber or a pressure-balanced chamber.

In both the first and second type systems, the output shaft and the drive shaft can be coupled via a magnetic coupling or a rotating seal in case that the output shaft rotates in an atmospheric chamber or a pressure-balanced chamber. A gearbox may optionally be provided between the output shaft of the electric motor and the drive shaft of the conveyor means.

In the first type power system, reverse movement of the conveyor means can be achieved by running the electric motor in reverse direction.

Moving the conveyor means in reverse direction has a general advantage that a possible overload having gathered in the reach of the conveyor means, can be released again by reversing the direction of movement and dumping abrasive particles into the return stream again. Herewith clogging of the recirculation system can be avoided.

In case of conveyor means in the form of a magnet, an overload may occur, for example, during a standstill of the system such as occurs during connecting a new joint of drill pipe to the drill string. A possible sequence for starting up can involve reversely moving the conveyor means during a first stage of starting up while the return stream is flowing, switching the conveyor means to forward, or normal, direction of movement. Advantageously, the conveyor means is switched to reverse movement again just prior to ending an excavation operation. This may be automatically triggered by a drop in flow rate, for instance.

I claim:

1. A system for making a hole in an object, the system comprising jet means for generating an abrasive jet comprising a mixture containing a fluid and a quantity of abrasive particles and for blasting the abrasive jet with an erosive power into impingement with the object in an impingement area, thereby eroding the object in the impingement area, the system further comprising scanning means for moving the impingement area along a selected trajectory in the hole, and modulation means for modulating the erosive power of the abrasive jet while the impingement area is being moved along the selected trajectory, wherein the modulation means is arranged to modulate the quantity of abrasive particles in the mixture and wherein the modulation means comprises modulation control means arranged to control the modulation means such that the erosive power of the abrasive jet is modulated in relation with the position of the impingement area on the selected trajectory.

2. The system of claim 1, wherein the scanning means comprises rotary means for rotating the abrasive jet about a rotary axis, whereby the impingement area is positioned off-axis with respect to the rotary axis.

3. The system of claim 1, comprising a positional sensor for providing a signal indicative of the position of the impingement area on the selected trajectory.

4. The system of claim 1, comprising a navigational sensor for providing a signal indicative of a direction under which the making of the hole in the object progresses.

5. The system of claim 1, wherein the modulation means comprise means for modulating the power vested in kinetic energy of the abrasive particles.

6. The system of claim 1, wherein the modulation means comprises velocity control means arranged to modulate the velocity of the abrasive particles in the abrasive jet.

7. The system of claim 6, wherein the jet means comprises an acceleration nozzle across which a pressure drop is maintainable, whereby the velocity control means comprises pressure control means arranged to modulate the pressure drop.

8. The system of claim 1, comprising a mixing chamber for mixing the fluid with the abrasive particles, and further comprising abrasive particle supply means for supplying the abrasive particles to the mixing chamber, whereby the modulation means is arranged to modulate the rate at which the abrasive particle supply means supplies the abrasive particles to the mixing chamber thereby modulating the quantity of abrasive particles in the mixture.

9. The system of claim 8, wherein the abrasive particle supply means comprises recirculation means arranged to recirculate at least a part of the abrasive particles from a return stream of the mixture downstream impingement with the object into the mixing chamber, whereby the modulation means is arranged to modulate at least the recirculation rate.

10. The system of claim 8, wherein the abrasive particle supply means comprises conveyor means arranged such that operation of the conveyor means induces transport of the abrasive particles, whereby the modulation means is arranged to modulate at least the rate of transport induced by the conveyor means.

11. The system of claim 10, wherein the conveyor means is movable, whereby movement of the conveyor means induces the transport of the abrasive particles.

12. The system of claim 10, wherein the conveyor means are coupled to a controllable down hole power system for operating the conveyor means and driving the conveyor means into movement.

13. The system of claim 12, wherein the controllable down hole power system comprises an electric power generator drivable by a fluid flow, an electric motor mechanically coupled to the conveyor means for driving the conveyor means into movement, whereby the electric motor is electrically coupled to the electric power generator via an electronic control system.

14. A system for making a hole in an object, the system comprising jet means for generating an abrasive jet comprising a mixture containing a fluid and a quantity of abrasive particles and for blasting the abrasive jet with an erosive power into impingement with the object in an impingement area, thereby eroding the object in the impingement area, the system further comprising scanning means for moving the impingement area along a selected trajectory in the hole, and modulation means for modulating the erosive power of the abrasive jet while the impingement area is being moved along the selected trajectory, wherein the modulation means comprise means for modulating the power vested in kinetic energy of the abrasive particles; wherein the modulation means comprises velocity control means arranged to modulate the velocity of the abrasive particles in the abrasive jet; and wherein the jet means comprises an acceleration nozzle across which a pressure drop is maintainable, whereby the velocity control means comprises pressure control means arranged to modulate the pressure drop.

* * * * *